United States Patent [19]

Knabenhans et al.

[11] Patent Number: 4,999,926

[45] Date of Patent: Mar. 19, 1991

[54] METHOD OF AND APPARATUS FOR REDUCING THE STICKINESS OF THE FIBERS OF COTTON FLOCKS CONTAMINATED WITH HONEYDEW

[75] Inventors: Fritz Knabenhans, Winterthur; Othmar Bachmann, Gachnang, both of Switzerland

[73] Assignee: Maschinenfabrik Rieter AG, Winterthur, Switzerland

[21] Appl. No.: 363,784

[22] Filed: Jun. 9, 1989

[30] Foreign Application Priority Data

Jun. 28, 1988 [DE] Fed. Rep. of Germany ..... 3821765

[51] Int. Cl.[5] ..... F26B 3/34

[52] U.S. Cl. ..... 34/1; 34/90; 19/66 CC; 19/66 R

[58] Field of Search ..... 34/1, 19, 60, 90; 19/66 CC, 66 R, 200, 27

[56] References Cited

U.S. PATENT DOCUMENTS

| | | | |
|---|---|---|---|
| 802,031 | 4/1974 | Crawford | 19/66 R |
| 2,124,012 | 7/1938 | Smith, Jr. | 34/1 |
| 2,304,983 | 12/1942 | Winkley et al. | 34/48 |
| 2,949,677 | 8/1960 | Cameron | 34/1 |
| 4,796,334 | 6/1989 | Yecheskel et al. | 19/27 |

FOREIGN PATENT DOCUMENTS

| | | |
|---|---|---|
| 0196449 | 10/1986 | European Pat. Off. . |
| 0303575 | 2/1989 | European Pat. Off. . |
| 175338 | 3/1905 | Fed. Rep. of Germany . |
| 1133286 | 10/1959 | Fed. Rep. of Germany . |
| 3430673 | 2/1986 | Fed. Rep. of Germany . |
| 3538899 | 5/1987 | Fed. Rep. of Germany . |
| 2183110 | 12/1973 | France . |
| 2384041 | 3/1978 | France . |
| 557435 | 6/1974 | Switzerland . |
| 433091 | 8/1935 | United Kingdom . |
| 1376136 | 12/1974 | United Kingdom . |
| 2030440 | 4/1980 | United Kingdom . |

*Primary Examiner*—Albert J. Makay
*Assistant Examiner*—John Sollecito
*Attorney, Agent, or Firm*—Sandler, Greenblum & Bernstein

[57] ABSTRACT

The invention relates to a method of and an apparatus for reducing the stickiness or tackiness of the fibers of honeydew-contaminated cotton flocks by heating the same. For this purpose, the cotton flocks while still in bale form are heated in a high-frequency electrical or electromagnetic field until the honeydew is brought to an elevated temperature and the water contained in the honeydew contamination is substantially evaporated, the temperature preferably being such that the cotton flocks reach a temperature in the region of the temperature of ebullition or boiling point of water.

17 Claims, 2 Drawing Sheets

METHOD OF AND APPARATUS FOR REDUCING THE STICKINESS OF THE FIBERS OF COTTON FLOCKS CONTAMINATED WITH HONEYDEW

CROSS REFERENCE TO RELATED APPLICATIONS AND PATENT

This application is related to copending U.S. application Ser. No. 07/132,790, filed Dec. 10, 1987, entitled "TREATMENT OF COTTON", now U.S. Pat. No. 4,888,856, granted Dec. 26, 1989 and which application is a divisional application to U.S. application Ser. No. 06/833,987, filed Feb. 26, 1986, entitled "TREATMENT OF COTTON", now U.S. Pat. No. 4,796,334, granted Jan. 10, 1989, which is related also to copending U.S. application Ser. No. 07/207,252, filed Jun. 15, 1988, entitled "TREATMENT OF COTTON", and which application is a continuation application to the aforementioned parent application, namely U.S. application No. 06/833,987. This application is also related to the commonly assigned U.S. application Ser. Nos. 07/359,495, filed May 31, 1989, and entitled "METHOD OF AND APPARATUS FOR TREATING COTTON CONTAMINATED WITH HONEYDEW", and Ser. No. 07/359,494, filed May 31, 1989, and entitled "METHOD OF AND APPARATUS FOR REDUCING THE STICKINESS OF COTTON FLOCKS",

BACKGROUND OF THE INVENTION

The present invention broadly relates to a method of and apparatus for treating cotton flocks at an early stage of cotton processing and, more specifically, pertains to a new and improved method of reducing the stickiness or tackiness of the fibers of cotton flocks contaminated with honeydew. The present invention also relates to a new and improved apparatus for reducing the stickiness of the fibers of honeydew-contaminated cotton flocks.

Generally speaking, the present invention relates to a new and improved method of the type hereinbefore described and which method entails heating the honeydew-contaminated cotton flocks.

It is known that cotton flocks of certain provenances or origins are contaminated or coated to varying degrees with sugar-containing secretions from insects. These secretions containing sugar are generally known as honeydew. A large number of proposals have been made as to how honeydew can be made to caramelize by heating cotton flock samples for the purpose of determining the degree of honeydew contamination from the resulting change in the color of the cotton flocks. This is namely very important because in the event of considerable contamination, the cotton flocks become sticky or tacky and tend to stick or adhere to various parts of the yarn production plant or to form laps or coils at rolls or rollers or other rotatable members, this being very undesirable since it results in frequent interruption of the yarn manufacturing process and in an inferior yarn.

A method of the aforementioned type is already disclosed in European Patent Application No. 86.102352.1, published Oct. 8, 1986 under European Patent Publication No. 196,449. The object of this known method is to convert any contaminating honeydew into a non-sticky or non-tacky and brittle state or condition by supplying heat for a short period of time and preferably without causing any discoloration or change in the color of the cotton flocks, so that the brittle sugar deposits can be crushed and removed in the course of subsequent processing.

A number of devices or apparatuses for performing this prior art method have been proposed in the above-mentioned European Patent Application No. 86.102352.1, published under European Patent Publication No. 196,449. One device or apparatus is intended to heat the fiber flocks before the actual opening of the raw cotton bales, i.e. directly at the start of the yarn manufacturing process. On the other hand, other devices or apparatuses are intended for treating fiber slivers between the card and drafting arrangement or during drafting.

In spinning mills, in which the cotton spun is heavily contaminated with honeydew, efforts are made to keep the ambient air moisture or humidity very low, and experience has shown that this results in reduction of the frequency of interruptions in the yarn manufacturing process. However, the very low air humidity is undesirable as such, since the cotton fibers suffer mechanical damage during yarn manufacture such that the yarn quality is not at an optimum although the best types of cotton in terms of quality originate from provenances where the honeydew contamination is quite considerable. Also, very dry air causes problems with regard to electrostatic charges which result, for example, in undesirable accumulations of fly fibers. Furthermore, in the case of a very low air humidity, the operating staff or personnel finds the climatic conditions inside the spinning mill unpleasant.

As a result of such difficulties many yarn manufacturers first wash the cotton flocks in order to remove the honeydew deposits. However, washing is not only expensive, but also results in reduction or deterioration of yarn quality.

Since only some types of cotton or deliveries of cotton are contaminated with honeydew, the installation of special continuous treatment plants, for instance in accordance with the disclosure of the aforesaid European Patent Application No. 86.102352.1, published under European Patent Publication No. 196,449, is in many cases undesirable, particularly since there is frequently no space at all for any subsequent installation.

SUMMARY OF THE INVENTION

Therefore, with the foregoing in mind, it is a primary object of the present invention to provide a new and improved method of, and apparatus for, reducing the stickiness or tackiness of the fibers of cotton flocks contaminated with honeydew, and which method and apparatus do not exhibit the aforementioned drawbacks and shortcomings of the prior art.

Another and more specific object of the present invention aims at providing a new and improved method of reducing the stickiness or tackiness of the fibers of cotton flocks contaminated with honeydew, and which method does not require extensive preparatory operations and permits using the simplest possible means requiring a minimum of space, so that by means of the inventive method cotton bales or at least large parts thereof are pretreated, at least hours or preferably days or even weeks prior to the actual yarn manufacturing process, such that interruptions of the yarn manufacturing process due to honeydew contamination are largely avoided without the cotton fibers being exposed to mechanical damage and without the subsequent yarn processing having to take place in the presence of very low air humidity.

Now to implement these and still further objects of the invention, which will become more readily apparent as the description proceeds, the method of the present invention of reducing the stickiness or tackiness of the fibers of cotton flocks contaminated with honeydew is manifested, among other things, by the steps of heating the cotton flocks while still in bale form in a high-frequency field, i.e. electrical or electromagnetic field and bringing the honeydew to an elevated temperature, thus substantially evaporating the water contained in the honeydew contamination. The step of heating the cotton flocks entails a temperature increase of the cotton flocks to reach a temperature in the region of the temperature of ebullition or boiling point of water. The term "high-frequency" as used in this disclosure is intended to also encompass microwave frequencies.

Although it is generally known that cotton fibers very rapidly absorb ambient humidity, it has surprisingly been found that after the pretreatment of the cotton bales according to the new and improved method of the present invention, the stickiness or tackiness of the honeydew contamination is essentially reduced. Furthermore, it has surprisingly been found that the contaminations thus treated only slowly re-absorb moisture from the air or from the fibers to which they adhere, so that it is readily possible to pretreat the bales even more than a week prior to their use for yarn manufacture without the risk of increased stickiness or tackiness during actual yarn manufacture. This behavior is attributed to a change of the condition or state of the honeydew contamination as a result of the heat treatment. This change of properties occurs particularly when the cotton flocks undergo appropriate heating.

Preferably, the high-frequency field is produced by field generating elements arranged at opposite sides of the bale or bale portion. This ensures that a good depth of penetration of the energy is achieved so that the treatment of entire bales is rendered possible.

The high-frequency field may be a high-frequency electrical field which is generated between the plates of a capacitor, such plates constituting field generating elements. A problem can arise here inasmuch as the capacitance of the capacitor varies during evaporation of water, so that the resonant or oscillatory circuit formed by the electrical components associated with the capacitor and intended to oscillate at a very accurately set frequency, the permissible frequencies being regulated by law, tends to drift away from resonance. In other high-frequency installations this phenomenon is counteracted by varying the spacing of the capacitor plates.

This is basically possible with respect to the inventive method. However, there is a preferred arrangement in which an additional capacitor is connected in parallel to the capacitor formed by the aforesaid capacitor plates between which the cotton bale is located, adjustment being effected by a change alteration of the adjustable additional capacitor. According to the invention, there is thus rendered possible a very rapid and accurate adjustment or adaptation of the resonant frequency of the load circuit.

In a preferred variant of the inventive method, the high-frequency field is the electromagnetic field of a microwave generator or of a plurality of microwave generators jointly heating the cotton bale. Although this may be somewhat surprising at first, since it would be initially assumed for technical reasons and considerations that the penetration depth of microwaves or microwave energy into a densely compressed cotton bale would be relatively limited. However, it has been found that this penetration depth rapidly increases with increasing temperature within the cotton bale, so that very uniform heating of the entire cotton bale is possible. This uniform heating particularly occurs when the field generating elements are disposed laterally of the cotton bale and means are provided in order to repeatedly reflect the microwave radiation to and fro through the cotton bale. This arrangement also beneficially influences the escape of water vapor occurring during heating, such water vapor ascending and being extractable from the top of the associated oven or furnace.

A characteristic of heating by means of microwaves, i.e. microwaves energy, also resides in the fact that these microwaves appear to selectively act on the honeydew contaminations so that the latter reach a temperature somewhat higher than the temperature of the cotton itself. This ensures that the moisture is very rapidly expelled from the honeydew contamination and that the required change of state or condition or structure of the honeydew contamination occurs without the cotton flocks themselves having to be heated to a temperature at which a fire hazard would occur. The selective action on the honeydew contaminations also enables the treatment times to be shortened and the required amount of energy to be reduced. This, in turn, is for the benefit of the method in terms of economy of operation and constructional expenditure.

A particular feature of the method according to the invention is characterized in that the gases or air used to cool the microwave generator or each microwave generator, subsequent to flowing through the or each microwave generator, are injected into the microwave oven containing the cotton bale or bales and flow through the microwave oven to achieve an additional drying of each of the cotton bales and/or carry away escaping water vapor or steam. In this manner, the flow of gas or air used for cooling is utilized for a two-fold purpose in that the heat carried away from the microwave generators is not lost, in that it is beneficially used to extract moisture.

It has been found according to the inventive method that the treatment time can be readily selected in the range of 5 minutes to 90 minutes, depending on the moisture of the cotton bales, it being advantageous to use power in the range of 0.02 to 0.08 kilowatts per kilogram bale weight. Thus with average power and average moisture it is possible to treat a cotton bale in less than 30 minutes, so that a single microwave oven would be able to handle or cope with the entire daily production of a medium-sized cotton spinning mill. With such a treatment time there is also sufficient time available to ensure that produced water vapor or steam escapes from the cotton bale. The treatment is preferably continued until the residual moisture in the cotton is on average in the range of 4% to 1% water.

A further particularly preferred feature of the inventive method is characterized in that the microwave generator power during the pretreatment is reduced by an open loop control system or a closed loop control system in accordance with a predetermined or measured course of moisture reduction. This method results in very protective treatment of the cotton and in substantial energy saving, particularly because the cotton can steam out during reduced energy supply times, thus also reducing the risk of local overheating of the cotton.

As alluded to above, the invention is not only concerned with the aforementioned method aspects, but also relates to a new and improved construction of apparatus for carrying out the inventive method.

To achieve the aforementioned measures, the inventive apparatus, in its more specific aspects, is manifested, among other things, by the features that the apparatus comprises an oven or furnace for accommodating cotton bales, field generating elements or means arranged at opposite sides of the cotton bales for heating the latter inside the oven, and means for generating an airflow through the oven.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein.

DETAILED DESCRIPTION OF THE PREFERRED EMBODIMENTS

Figure 1:
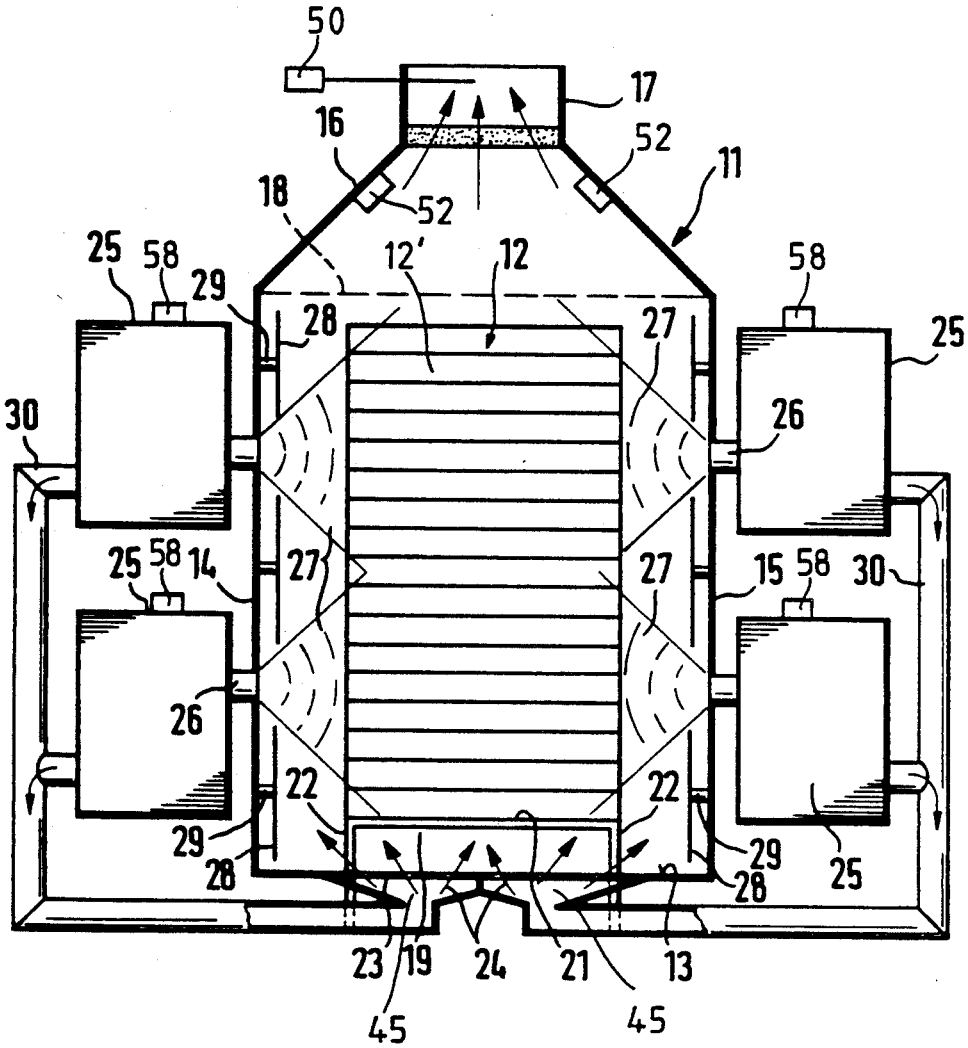
FIG. 1 is a schematic cross-section through a first exemplary embodiment of the apparatus constructed according to the invention and in which a cotton bale is heated by means of microwaves or microwave energy.

Describing now the drawings, it is to be understood that to simplify the showing thereof, only enough of the structure of the apparatus for realizing the inventive method of reducing the stickiness or tackiness of the fibers of honeydew-contaminated cotton flocks in bale form has been illustrated therein as is needed to enable one skilled in the art to readily understand the underlying principles and concepts of this invention. Turning attention now specifically to FIG. 1 of the drawings, the exemplary embodiment of apparatus illustrated therein by way of example and not limitation will be seen to comprise a microwave oven or furnace 11 shown in a sectional view taken through a substantially vertical plane. This microwave oven 11 is specially designed to treat cotton bales 12 in accordance with the inventive method and one or more cotton bales 12 can be treated therein. The microwave oven 11 itself comprises a base or bottom 13, a left side wall 14 and a right side wall 15, a top or upper side 16 which is formed as a chimney, tapered upwards and merges into a connecting pipe or stud 17. The microwave oven 11 also possesses a back or rear wall 18 which for the sake of clarity is shown only in broken lines in FIG. 1, and a door hinged on one of the side walls 14 and 15 to enable the cotton bale or bales 12 to be introduced into the microwave oven 11. The hinged door is not particularly shown in the drawing. If desired the back or rear wall 18 can also be constructed as a door so that the cotton bales 12 can be introduced through the front and taken out at the rear.

In a top plan view or a horizontal sectional view the microwave oven 11 is of substantially square or rectangular configuration and its dimensions are adapted to those of a conventional cotton bale 12, but can be selected to be somewhat smaller if, and this is basically possible, only a fraction of a cotton bale 12, for instance half a cotton bale 12, is to be treated in one operation. Within the microwave oven 11 the cotton bale 12 stands with its layers 12' extending substantially horizontal on a platform 19 which is constructed as a grid through which there can pass microwaves, so that the bottom or lower side 21 of the cotton bale 12 is somewhat higher than the base or bottom 13 of the microwave oven 11. The platform 19 stands on individual legs 22 or the like between which there are suitable openings not particularly shown in the drawings. The interior or inner space of the microwave oven 11 should be larger than the space occupied by the cotton bale 12 and/or have a guide to prevent the cotton bale 12 from jamming in the microwave oven 11 if the cotton bale 12 expands and becomes larger due to the heat treatment.

The middle or center part of the base or bottom 13 is constructed as a course-mesh screen or perforate plate 23 which is non-previous to microwaves or microwave energy so that air 24 coming from below can flow through this screen or perforate plate 23 and through the aforesaid openings provided between the individual legs 22. The top of the platform 19 is also constructed as a screen or perforate plate to enable the air 24 to have access to the cotton bale 12 and also to enable water vapor or steam escaping from the cotton bale 12 to pass through the platform 19.

Individual microwave generators 25 are arranged laterally of the microwave oven 11 although the drawing only shows four such microwave generators 25, namely two on the left side and two on the right side. The microwave generators 25 are arranged one above the other in two substantially horizontal planes. Although not shown in the drawing, further microwave generators 25 can be arranged in planes behind or in front of the plane of the drawing of FIG. 1, for example, to provide a total of twelve such microwave generators 25. A radiation outlet 26 of each microwave generator 25 projects through an associated waveguide into one of the side walls 14 and 15 of the microwave oven 11 and is directed towards the interior thereof. In this manner, radiation lobes or beams 27 of substantially funnel-divergent shape are formed, during operation, by the associated microwave generators 25, the arrangement being such as to give the maximum possible energy density in the cotton bale 12.

A plurality of wave agitators or wavers 28 are mounted at the side walls 14 and 15 of the microwave oven 11, each wave agitator 28 consisting basically of a circular metallic rotor mounted on a rotational axle or spindle 29 and driven to perform slow rotary movements, for example, ten revolutions per minute. The purpose of these wave agitators 28 is initially to reflect the radiation passing through the cotton bale 12 back and forth, so that each radiation lobe or beam 27 repeatedly passes through the cotton bale 12 before being completely absorbed. Reflection of microwaves, which reflection occurs at each metal or metallic surface, results in the energy density in the cotton bale 12 being rendered uniform to some extent. The operation of the wave agitators or wavers 28 serves to provide further uniformity of the energy density within the cotton bale 12.

The individual microwave generators 25 have to be cooled during operation, for which purpose air is pumped through these microwave generators 25 by any suitable pumping means 58. In the present example this air, after cooling the microwave generators 25, is injected or blown into collecting headers or pipes 30 which lead to an air chamber 45 located beneath the coarse-mesh screen or perforate plate 23 of the microwave oven 11. In this manner the heated-up air passes into the microwave oven 11 and ensures further heating of the cotton bale 12 and the removal of water vapor escaping as a result of the heat treatment of the cotton bale 12, such water vapor initially ascending to the connecting pipe or stud 17 and then being suction-extracted by a blower or fan, generally indicated by reference numeral 50.

The microwave generators 25 each preferably have a maximum power output of about 1.2 kilowatts, and this means that with a total of twelve microwave generators 25 it is possible that a cotton bale 12 weighing approximately 220 kilograms and having an original 6% water content can be dried in about 14 minutes to have a residual moisture of 4% water. If even dryer cotton is required, for instance cotton with a residual moisture of 1%, the treatment time is extended to about 35 minutes.

It is actually not the residual moisture in the cotton itself that is important. What is important is that the moisture of the honeydew deposits or contaminants, which moisture may initially be much higher than the average moisture in the cotton bale 12, is itself reduced, this being particularly favorably achievable by means of microwaves, since microwave energy is preferentially absorbed by the water contained in honeydew. It can therefore be stated that drying of cotton to a residual mositrue of 2% to 4% is sufficient to expel the excess water from the honeydew and, as assumed, bring about a change of state or condition or structure thereof, so that the tendency of these deposits to re-absorb water is substantially reduced.

Fire monitoring devices, i.e. signalling fire detectors, as schematically conveniently indicated in FIG. 1 by reference numeral 52, are installed at individual locations in the microwave oven 11 itself to detect any fire and immediately stop the supply of energy to the microwave generators 25. If required the signals of these signalling fire detectors 52 can be used to inject a quenching gas into the microwave oven 11 n order to immediately extinguish any developing fire. A particular advantage of microwave heating is that the energy supply can be immediately stopped and that the microwave oven 11 is immediately cool after the microwave generators 25 have been switched off, so that the risk of any fire outbreak by additional absorbed heat is extremely small.

Figure 2:
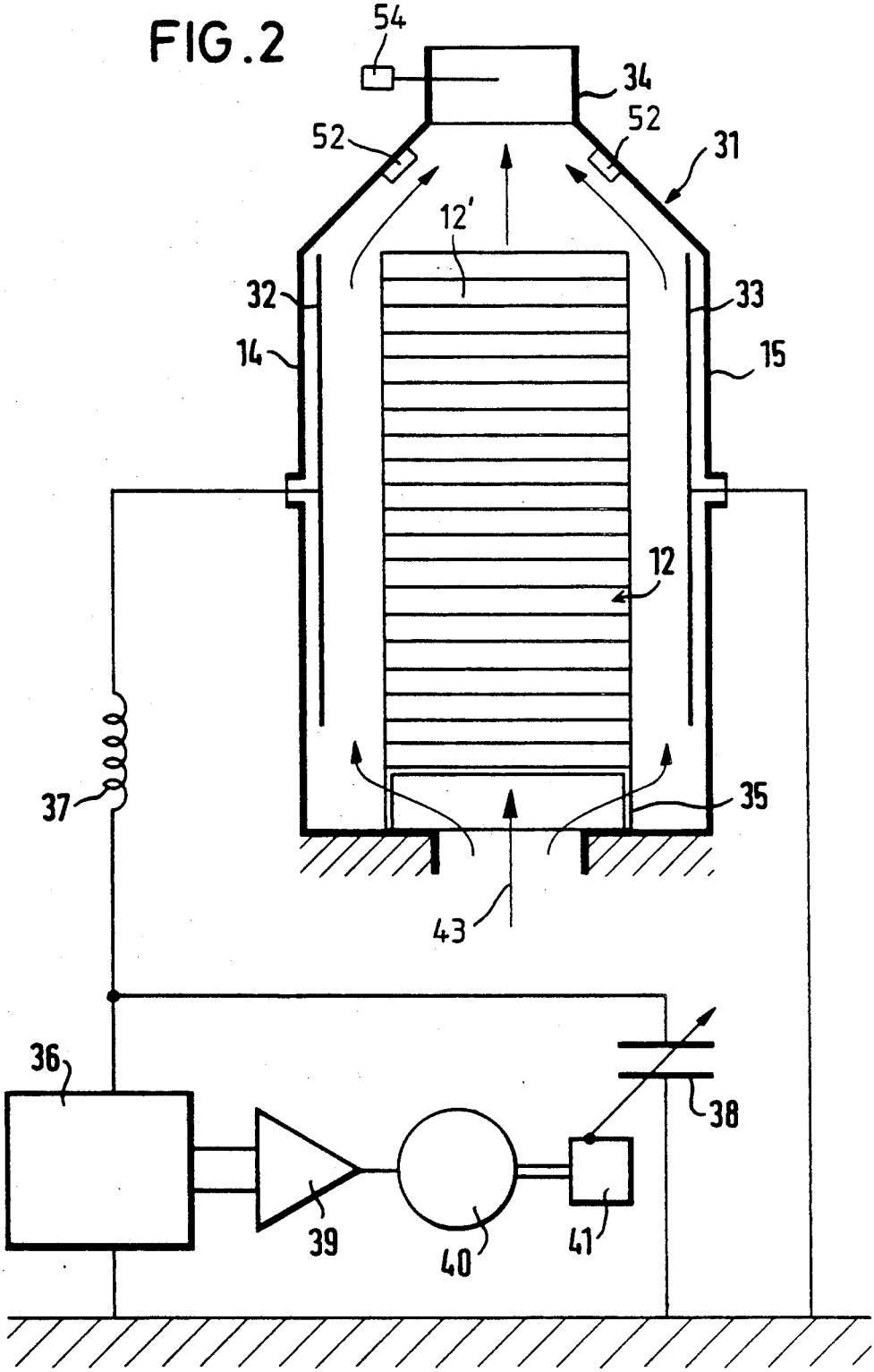
FIG. 2 is a schematic cross-section through a second exemplary embodiment of the apparatus constructed according to the invention and in which cotton bales can be heated by means of high-frequency energy.

A further possibility of pretreating entire cotton bales 12 or fractions thereof in accordance with the invention is schematically illustrated in FIG. 2. An oven 31 of this embodiment is of similar configuration to the microwave oven 11 in FIG. 1 but, instead of using microwave generators 25, two substantially rectangular capacitor plates 32 and 33 are provided within this oven 31, the plate 32 being arranged substantially in parallel with the left side wall 14 of the oven 31 and the plate 33 substantially in parallel with the right side wall 15 of the oven 31.

A high-grade dielectric is used between the two substantially rectangular capacitor plates 32 and 33 and the associated side walls 14 and 15 of the oven 31. In this embodiment the cottom bale 12 likewise rests on a platform 35 of grid-like construction and an air current or flow 43 is generated from below in the upward direction to remove water vapor occuring during treatment. This air current or flow 43 can be produced by means of a blower or fan, generally indicated by reference numeral 54 in FIG. 2, connected to a connecting pipe or stud 34 via a line or conduit. A high-frequency electrical alternating field forms between the two capacitor plates 32 and 33, with the result that the cotton which represents a high-loss dielectric, is heated. In this manner, the maximum heat absorption is in the zone of high water content, for example, in the honeydew.

The high-frequency electrical alternating field is generated by a high-frequency generator 36 which feeds electrical energy to a working or operating circuit comprising an inductance 37 and the capacitor formed by the capacitor plates 32 and 33 between which there is located the cotton bale 12 serving as a dielectric. The frequency of the power supply and therefore of the high-frequency electrical alternating field must be maintained within close limits in view of regulations set by law in a number of countries, such regulations concerning limitation of stray radiation from industrial high-frequency installations. The working or operating frequency usually selected will be the industrial frequency of 27.12 MHz±0.6% or, in rare cases 13.56 MHz±0.05%.

Since the energy transmission from the high-frequency generator 36 to the working or operating circuit can be at a maximum only if the resistance of the working or operating circuit is adapted to that of the high-frequency generator 36, and since the resistance of the working or operating circuit varies according to the nature and moisture content of the actually provided cotton bales 12, it is necessary to match or adapt, during the heating process, the working or operating circuit to the high-frequency generator 36.

This is achieved, according to the invention, in that an additional capacitor 38 is connected in parallel with the load circuit and is adjusted by a controller or control unit 39 via a motor 40 and a transmission 41 or equivalent structure in order to keep constant at all times the resonant or oscillatory frequency of the load circuit.

The actual value fed to the controller or control unit 39 is the anode current of the high-frequency generator 36 or a value equivalent or corresponding thereto, and the controller or control unit 39 compares this actual value or equivalent value with a predetermined desired or reference value. In the event of any deviation, a signal is applied to the motor 40 which adjusts the additional capacitor 38 via the transmission 41 until the desired or reference value of the anode current is restored.

In operation, the cotton bale 12 is heated by the high-frequency electrical field between the two substantially rectangular capacitor plates 32 and 33 such that the moisture is expelled from the honeydew and the latter is brought to the desired or required state or condition.

Also in this exemplary embodiment of the inventive apparatus the inner space of the oven 31 should be greater than the cotton bale 12 or have a suitable guide. Here again it is advantageous to guide the waste heat of the high-frequency generator 36 through the oven 31 in the form of a heated air current or flow. Suitable fire monitoring devices or fire detectors 52 are here likewise shown in FIG. 2.

If the cotton bale 12 to be pretreated is held together by metal strapping or bands, such metal strapping or bands should be removed and replaced by suitable plastic strapping or bands prior to introducing the cotton bale 12 into the oven 31.

While there are shown and described present preferred embodiments of the invention it is to be distinctly understood that the invention is not limited thereto, but maybe otherwise variously embodied and practiced within the scope of the following claims, ACCORDINGLY,

What we claim is:

1. A method of heat treating a bale of moisture containing cotton flocks contaminated with honeydew, comprising the steps of:

heating in depth the bale of moisture containing cotton flocks contaminated with honeydew by exposing said bale to a high-frequency electromagnetic field;

during a first phase of said in depth heating of said bale of moisture and honeydew containing cotton flocks, bringing the honeydew to an elevated temperature and thus substantially evaporating moisture contained in the honeydew for substantially irreversibly reducing the stickiness of said honeydew to an insignificant degree and said step of heating in depth the bale of moisture and honeydew containing cotton flocks entailing the step of increasing the temperature of the cotton flocks to a temperature in the region of the boiling temperature of water and thereby reducing the moisture content of said cotton flocks to a predetermined extent.

2. The method as defined in claim 1, further including the step of:

arranging high-frequency electromagnetic field generating elements at opposite sides of the bale of moisture and honeydew containing cotton flocks; and said step of heating in depth said bale of moisture and honeydew containing cotton flocks entailing the step of exposing said bale of moisture and honeydew containing cotton flocks from both said opposite sides to said high-frequency electromagnetic field and thereby substantially uniformly heating in depth said bale of moisture and honeydew containing cotton flocks.

3. The method as defined in claim 2, wherein:

said step of arranging said high-frequency electromagnetic field generating elements at opposite sides of said bale of moisture and honeydew containing cotton flocks entails arranging on said opposite sides plates of capacitor for connection to a high-frequency electromagnetic field generator.

4. The method as defined in claim 1, wherein:

said step of heating in depth the bale of moisture and honeydew containing cotton flocks by exposing said bale of moisture and honeydew containing cotton flocks to said high-frequency electromagnetic field entails exposing the bale of moisture and honeydew containing cotton flocks to a microwave field.

5. The method as defined in claim 4, wherein:

said step of exposing the bale of moisture and honeydew containing cotton flocks to said microwave field entails exposing the bale of moisture and honeydew containing cotton flocks to the microwave field of a plurality of microwave generators.

6. The method as defined in claim 5, further including the steps of:

arranging the bale of moisture and honeydew containing cotton flocks in a microwave oven having an open top end and said plurality of microwave generators located in a lateral disposition with respect to said bale of moisture and honeydew containing cotton flocks;

during said steps of exposing said bale of moisture and honeydew containing cotton flocks to said microwave field and heating the cotton flocks to said temperature in the region of the boiling point of water, evaporating said moisture contained in said honeydew and said cotton flocks and generating water vapor which rises upwardly through and from said bale of moisture and honeydew containing cotton flocks; and extracting said water vapor at said open top end of the microwave oven.

7. The method as defined in claim 3, further including the steps of:

arranging the bale of moisture and honeydew containing cotton flocks in an oven having an open top end and containing said capacitor plates;

during said steps of exposing said bale of moisture and honeydew containing cotton flocks to said high-frequency electromagnetic field and heating the cotton flocks to said temperature in the region of the boiling point of water, evaporating said moisture contained in said honeydew and said cotton flocks and generating water vapor which rises upwardly through and from said bale of moisture and honeydew containing cotton flocks; and extracting said water vapor at said open top end of the oven.

8. The method as defined in claim 1, wherein:

said step of exposing said bale of moisture and honeydew containing cotton flocks to said high-frequency electromagnetic field entails applying a power in the range of 0.02 kilowatts to 0.08 kilowatts per kilogram of cotton for producing the high-frequency electromagnetic field; and exposing said bale of moisture and honeydew containing cotton flocks to the high-frequency electromagnetic field generated by said power for a time period in the range of 5 to 90 minutes.

9. The method as defined in claim 8, wherein:

said step of exposing said bale of moisture and honeydew containing cotton flocks entails a treatment time in the range of up to 30 minutes.

10. The method as defined in claim 1, wherein:

said step of reducing the moisture content of said cotton flocks to said predetermined extent entails reducing said moisture content to an average value in the range of 4% to 1%.

11. The method as defined in claim 1, wherein:

said step of exposing said bale of moisture and honeydew containing cotton flocks to said high-frequency electromagnetic field entails applying a predeterminate power to field generating elements arranged at said bale of moisture and honeydew containing cotton flocks; and during said step of reducing said moisture content of said cotton flocks to said predetermined extent, reducing the power applied to the field generating elements by an open loop control system in accordance with a predetermined course of moisture reduction.

12. The method as defined in claim 1, wherein:

said step of exposing said bale of moisture and honeydew containing cotton flocks to said high-frequency electromagnetic field entails applying power to field generating elements arranged at said bale of moisture and honeydew containing cotton flocks; and during said step of reducing said moisture content of said cotton flocks to said predetermined extent, reducing the power applied to the field generating elements by an open loop control system in accordance with a measured course of moisture reduction.

13. The method as defined in claim 1, wherein:

said step of exposing said bale of moisture and honeydew containing cotton flocks to said high-frequency electromagnetic field entails applying power to field generating elements arranged at said bale of moisture and honeydew containing cotton flocks; and during said step of reducing said moisture content of said cotton flocks to said predetermined extent, reducing the power applied to the field generating elements by a closed loop control system in accordance with a predetermined course of moisture reduction.

14. The method as defined in claim 1, wherein:

said step of exposing said bale of moisture and honeydew containing cotton flocks to said high-frequency electromagnetic field entails applying power to field generating elements arranged at said bale of moisture and honeydew containing cotton flocks; and during said step of reducing said moisture content of said cotton flocks to said predetermined extent, reducing the power applied to the field generating elements by a closed loop control system in accordance with a measured course of moisture reduction.

15. A method of reducing the stickiness of the fibers of cotton flocks contaminated with honeydew, by heating the contaminated cotton flocks in an oven, comprising the steps of;

heating the cotton flocks contaminated with honeydew while still in bale form in a high-frequency field;

bringing the honeydew to an elevated temperature and thus substantially evaporating water contained in the honeydew;

said step of heating the cotton flocks entailing a temperature increase of the cotton flocks to reach a temperature in the region of the temperature of ebullition of water;

arranging field generating elements at opposite sides of the cotton flocks while still in bale form for producing the high-frequency field;

said step of heating the cotton flocks while still in bale form in a high-frequency field entails heating the cotton flocks in a high-frequency electrical field generated between plates of a capacitor which form the field generating elements;

cooling the field generating elements by guiding a fluid medium through the latter;

injecting the fluid medium through the oven after flowing through the field generating elements; and guiding the injected fluid medium through the oven for additional drying of the cotton flocks and conveyance of escaping water vapor.

16. A method of reducing the stickiness of the fibers of cotton flocks contaminated with honeydew, by heating the contaminated cotton flocks in an oven, comprising the steps of;

heating the cotton flocks contaminated with honeydew while still in bale form in a high-frequency field;

bringing the honeydew to an elevated temperature and thus substantially evaporating water contained in the honeydew;

said step of heating the cotton flocks entailing a temperature increase of the cotton flocks to reach a temperature in the region of the temperature of ebullition of water;

said step of heating the cotton flocks while still in bale form in a high-frequency field entails heating the cotton flocks in an electromagnetic field of a plurality of microwave generators which jointly heat the cotton flocks and form field generating elements;

arranging the field generating elements laterally of the cotton flocks while still in bale form;

conveying substantially upwards in the oven water vapor escaping from the cotton flocks;

extracting such water vapor from a top end of the oven;

cooling the field generating elements by guiding a fluid medium through the latter;

injecting the fluid medium through the oven after flowing through the field generating elements; and guiding the injected fluid medium through the oven for additional drying of the cotton flocks and conveyance of escaping water vapor.

17. The method as defined in claim 16, wherein:

said step of heating the cotton flocks in an electromagnetic field of a plurality of microwave generators entails repeatedly reflecting the electromagnetic field which passes through the cotton flocks while still in bale form to and fro through the cotton flocks.

* * * * *